United States Patent [19]

Belser

[11] 4,259,797

[45] Apr. 7, 1981

[54] TOP ACCESS PRINTING BADGE HOLDER WITH PRINTING CARD GUIDES

[76] Inventor: Dana C. Belser, 3909 Blackthorn St., Chevy Chase, Md. 20015

[21] Appl. No.: 88,669

[22] Filed: Oct. 26, 1979

[51] Int. Cl.[3] ..... A44C 15/00

[52] U.S. Cl. ..... 40/1.5

[58] Field of Search ..... 40/10 D, 1.5, 1.6, 159

[56] References Cited

U.S. PATENT DOCUMENTS

| | | | |
|---|---|---|---|
| 3,295,235 | 1/1967 | Tauber | 40/1.5 |
| 3,355,826 | 12/1967 | Klein et al. | 40/1.5 |
| 3,371,829 | 3/1968 | Phillips | 40/1.5 |
| 3,657,834 | 4/1972 | Tauber | 40/1.5 |

*Primary Examiner*—Gene Mancene
*Assistant Examiner*—Wenceslao J. Contreras
*Attorney, Agent, or Firm*—Sughrue, Rothwell, Mion, Zinn and Macpeak

[57] ABSTRACT

A transparent convention badge holder of the type having front and rear panels and seals securing the panels to one another has a transverse seal and fold line forming an elongated compartment and a short pocket. The elongated compartment is adapted to be positioned in a coat pocket, with the short pocket suspended outwardly in exposed position over the coat pocket edge. The panels forming the exposed pocket are sealed together at their peripheral edges, and one of the panels has a horizontal slit formed therein and extending thereacross. A cut out is heat sealed about its periphery and is centered on the fold to permit grasping of a printing card/identity insert. A pair of vertical seals also join the panels, the vertical seals extending from slightly above the slit and serving as card guides for the removable positioning of the printing card/identity insert therein.

3 Claims, 3 Drawing Figures

TOP ACCESS PRINTING BADGE HOLDER WITH PRINTING CARD GUIDES

BACKGROUND OF THE INVENTION

1. Field of the Invention:

This invention pertains to a convention badge holder of the type wherein a printing card insert is removably supported in a pocket thereof.

2. Statement of the Prior:

In prior U.S. Pat. No. 3,657,834, a convention badge holder which removably supports a printing card is disclosed. Such holders, as disclosed in that patent may be either of the upright or fold over variety.

SUMMARY OF THE INVENTION

In the conduct of conventions, sales meetings, and the like, the use of printing inserts for badge holders is employed with increasing frequency. These printing card inserts serve the dual functions of (1) identification of the wearer, and (2) permitting recordal of information on imprinting equipment at selected locations. Thus, where an exhibitor wishes to maintain a list of the names of those persons expressing an interest in his exhibit during a meeting or convention, the information may be readily recorded. In order that these functions may be conveniently and efficiently met, it is necessary that the insert card be (1) uniformally and correctly positioned in the holder, and (2) readily mounted and demounted therefrom. In the arrangement herein developed, an exposed pocket of the holder has a horizontal slit with a finger slot. At the terminal ends of the slit, a pair of vertical seals form guide bars which insure the card location and permit unobstructed withdrawal thereof. Additionally, the holders are provided with a cut out at the upper extremity, to further assist in card removal and placement.

Other and further objects and advantages of the invention will become apparent to those skilled in the art from a consideration of the following specification when read in conjunction with the annexed drawings.

DESCRIPTION OF THE PREFERRED EMBODIMENT

Figure 1:
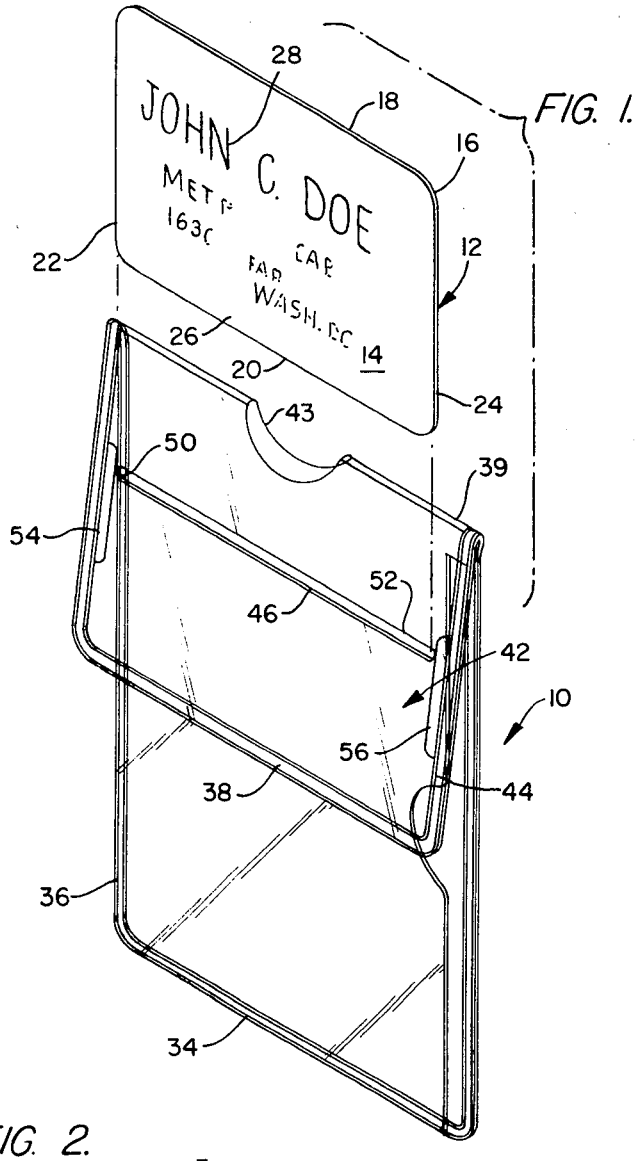
FIG. 1 is a disassembled perspective view showing a holder according to this invention and a printing card insert therefor.
Figure 2:
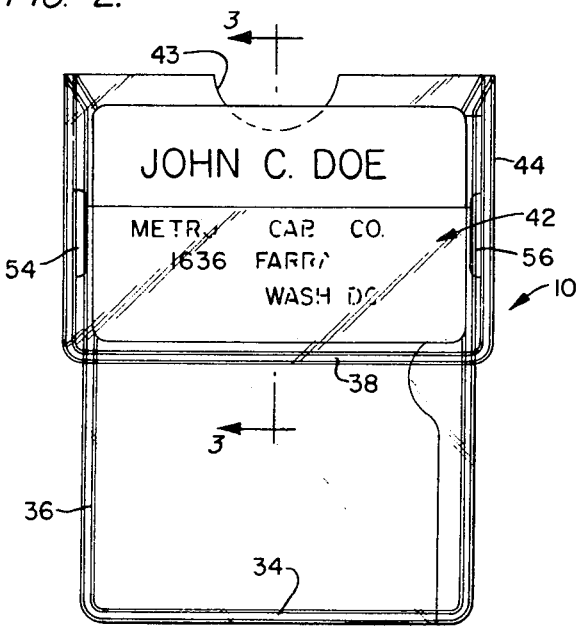
FIG. 2 is a front elevational view thereof.

Referring to the drawing in more detail, a holder according to this invention is therein generally identified by reference character 10. The holder 10 is for use with a printing card insert 12. The insert 12 comprises a relatively rigid, rectangular flat body 14 having rounded corners 16, top and bottom edges 18 and 20, and side edges 22, 24. Embossed on the insert card body 14, and visible on the front surface 26 thereof is informational indicia 28 such as the name and address of the wearer.

The holder 10 is formed from two panels of transparent plastic material, including a back panel 30 and a front panel 32. It will be observed that the front panel is die cut in such manner that its outer edges do not coincide in all instances with those of the back panel, as appears more fully below. However, the panels 30 and 32 are secured at their respective bottom edges by a heat seal 34, along one pair of side edges by a seal 36, and along their top edges by a seal 38.

Figure 3:
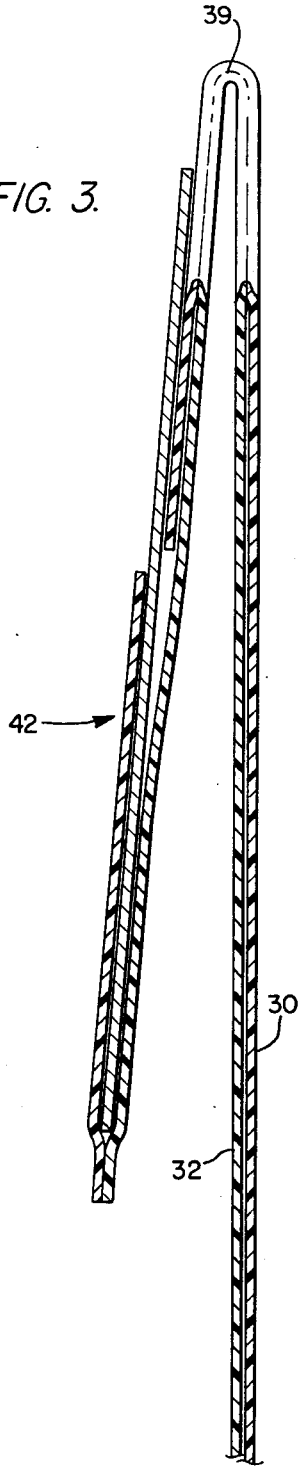
FIG. 3 is an enlarged, forshortened sectional view on line 3—3 of FIG. 2, looking in the direction of the arrows.

As best shown in FIG. 3, a transverse combined seal and fold line 39 extends across the panels at an intermediate location. The seal and fold line 39 divides the holder into a lower compartment 40 adapted to fit within the breast pocket of a jacket, and an exposed outer pocket 42. A further side heat seal 44 closes the outer pocket at the side thereof opposite from the seal 36. As the exposed pocket is folded over in the manner illustrated in the drawings, the rear panel 30 thereof is thus extended outwardly and the seal 38 becomes the subjacent edge of the folded over item.

The outer pocket 42 is in exposed position when the lower compartment is located in a pocket as described hereinabove, the fold line and seal area of the rear panel seating on and being supported by the pocket top edge.

A substantially circular cut out 43 is diametrically centered on the fold line 39, and is sealed on its perimeter to provide a slot for grasping the card 12 as appears below.

Access to the outer pocket for placement and removal of the insert card 12 is provided by a horizontal slit 46. The card 12 is intended to seat in the pocket, with the card bottom edge 20 engaging against the seal 38. The slit 46 has terminal ends 50 and 52. Extending vertically of slit 46 are a pair of guide members 54, 56 which extend to the terminal ends 50 and 52. The vertical guide members 54, 56 are located outside the slit and extends slightly above it. These serve to correctly position the insert card 12 in the pocket, and to prevent misalignment which would render it difficult to withdraw.

Thus, in use, the badge holder lower compartment may contain a card showing a schedule of events, or the like. The upper pocket carries the printing card insert, and exhibitors maintain devices such as those used to process credit cards which would print the information on the card 12. When an attendee indicates an interest in a particular exhibit, the card is withdrawn and his name is recorded by the foresaid printing process. The slot provided by the cut out 43 enables the user to readily grasp the card for removal.

I claim:

1. In a transparent convention badge holder of the type having a front panel, a rear panel, peripheral seals joining said panels together along at least two edges thereof, a fold line along an intermediate transverse seal forming an elongated compartment and a shorter exposed pocket, the elongated compartment being adapted to be disposed in the pocket of the wearer with the fold line positioned on the pocket top edge, and the exposed pocket being suspended over said last named edge, a relatively rigid printing card removably mounted in said exposed pocket, the improvements comprising:

the panels of the elongated compartment having side edges and one of said side edges of the front panels being spaced inwardly from the adjacent side edge of the rear panel, and being open to provide access to the elongated compartment;

the panels of the exposed pocket having side and end edges and being connected at all of said edges;

the rear panel of the exposed pocket having a horizontal slit formed therein with slit terminal ends, said slit located intermediate said fold line and said end edge;

a pair of vertical guide seals joining the front and rear panels of the exposed pocket and located exteriorly of the terminal ends of the slit; and the card being inserted between the panels through said slit and being guided by the guide seals which serve to correctly position said card within said exposed pocket.

2. The improvement of claim 1, and:

a thumb notch formed in the seals panels along said fold line.

3. The improvement of claim 1, wherein:

the card when inserted seats against the subjacent peripheral seal and extends outwardly of the slit.

* * * * *